United States Patent [19]

Clinton

[11] 4,042,778

[45] Aug. 16, 1977

[54] COLLAPSIBLE SPEAKER ASSEMBLY

[76] Inventor: Henry H. Clinton, R.F.D. No. 1, Ivoryton, Conn. 06442

[21] Appl. No.: 672,730

[22] Filed: Apr. 1, 1976

[51] Int. Cl.[2] ..... H04R 1/02; H04R 1/40

[52] U.S. Cl. ..... 179/1 E; 179/146 R

[58] Field of Search ..... 179/1 E, 146 R

[56] References Cited

U.S. PATENT DOCUMENTS 3,052,758 9/1962 Berry ..... 179/1 E

FOREIGN PATENT DOCUMENTS 939,513 2/1956 Germany ..... 179/1 E 1,030,869 5/1966 United Kingdom ..... 179/1 E

*Primary Examiner*—William C. Cooper

*Attorney, Agent, or Firm*—McCormick, Paulding & Huber

[57] ABSTRACT

A collapsible speaker assembly is formed by a split case in which a plurality of individual speakers are mounted. The split case is formed by two mating shells which are pivotally connected together at one side. When the shells are opened in 180° relationship with each other, a sound column is formed in which the speakers are held in a generally linear array. In use, the sound column is held in a vertical position for improved dispersion of sound in the horizontal plane of an audience.

13 Claims, 6 Drawing Figures

COLLAPSIBLE SPEAKER ASSEMBLY

BACKGROUD OF THE INVENTION

The present invention relates to sound producing equipment and, more particularly is concerned with a speaker assembly having electromagnetic speakers such as used in public address or music amplification systems.

Loud speakers for public address and music amplification uses have been made in several forms. It has been determined from experience that for reproduction of combined voice and music programs the so-called "sound column" gives results superior in most cases to those obtained from other speaker systems. The sound column has a plurality of speakers placed one above the other in a vertical line or array which results in a reduction of the vertical dispersion of sound and increases sound intensity in the normally horizontal plane of an audience. A sound column also reduces echos generated from walls and ceilings within the working environment.

Existing sound column designs are generally bulky, heavy and costly to manufacture. Because of the generally elongated configuration of the columns, they are not conveniently stored or transported from one place to another.

It is, accordingly, a general object of the present invention to provide a sound column type speaker assembly which is inexpensive, compact, light-weight in design, and convenient to store or transport.

SUMMARY OF THE INVENTION

The present invention resides in a collapsible speaker assembly which forms a sound column as described above.

The speaker assembly is comprised of a split case having two mating shells which are pivotally connected at one side. A plurality of speakers are mounted in the case and are completely enclosed within the case when the mating shells are closed. When the shells are opened 180° to one another, a sound column is formed in which the speakers are in a linear array.

The mating shells at their interface are similar in shape and elongated in a longitudinal direction. They also define a plurality of sound compartments arranged serially in the longitudinal direction, each compartment having a forward opening at the interface of the shells and being closed at the rear.

The speakers are mounted at the forward openings of the sound chambers and are recessed to permit the shells to be brought together in mating relationship without interference. Releasable means are provided for holding the split case closed when the pivoted shells are brought together.

Means such as a stand may also be connected with the split case for supporting the two shells in an upright position when the sound column is formed. In the upright position, the speakers and speaker compartments are situated in a generally vertical array.

The advantages of the collapsible speaker assembly are its light-weight, inexpensive and compact design. The shells are folded open to form the sound column and are folded closed for convenient storage and transportation. If desired, the pivotally connected shells may be separated to form two shorter sound columns. The columns may stand in an upright condition by themselves or a collapsible stand may be used to elevate the shells. An adjustable mount cooperating with the stand may be provided to tilt the sound column slightly relative to the horizontal plane. , cl BRIEF DESCRIPTION OF THE DRAWINGS FIG. 1 is a perspective view of the speaker assembly of the present invention with the pivotally connected shells open to form a sound column.

Figure 5:
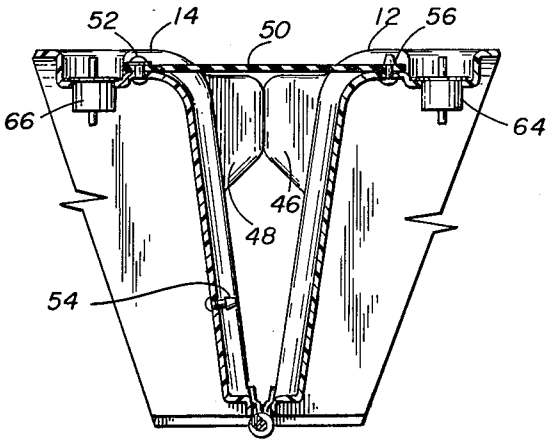

FIG. 5. is a fragmentary view of the speaker assembly and illustrates mechanism in one embodiment for holding the speaker assembly open.

Figure 6:
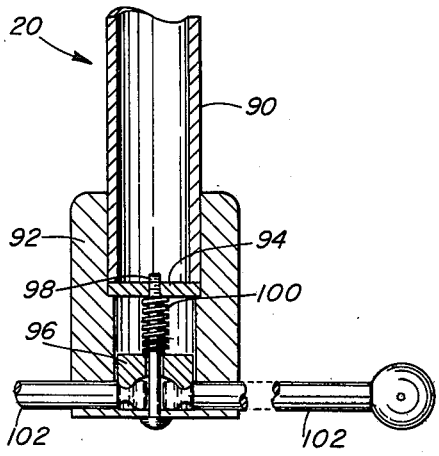

FIG. 6 is a detailed view of a collapsible stand base for the speaker assembly.

DESCRIPTION OF THE PREFERRED EMBODIMENTS

Figure 1:
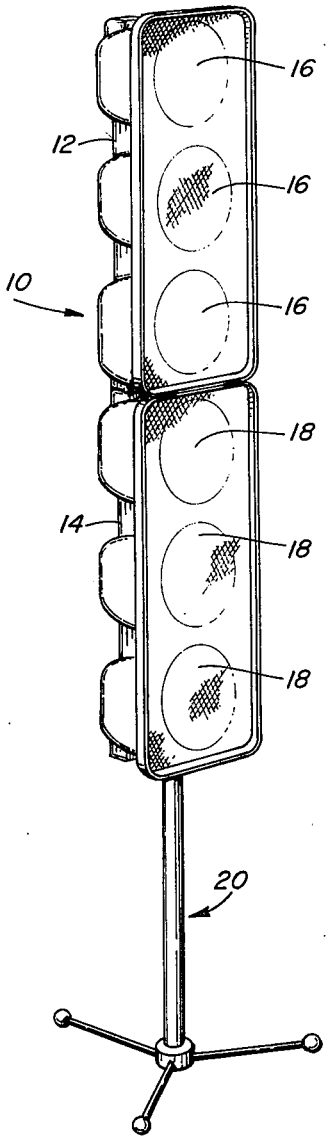

FIG. 1 illustrates the speaker assembly of the present invention unfolded or opened for use as a sound column. The speaker assembly, generally designated 10, includes a split case formed by two mating shells 12 and 14 and a plurality of moving coil, electrodynamic speakers 16 and 18 mounted within the respective shells. The shells are pivotally connected at one end or side of the case and may be formed from a molded plastic or a fiber-reinforced composite for light-weight design and structural integrity. A collapsible stand 20 engages the shell 14 at one end to hold the speaker assembly upright in an elevated position if desired. With the shells 12 and 14 folded open as shown, the speakers 16 and 18 are held in a linear, vertical array. Sound emanating from the assembly does not disperse as easily in the vertical direction and consequently is concentrated in intensity in the horizontal plane of the audience.

Figure 2:
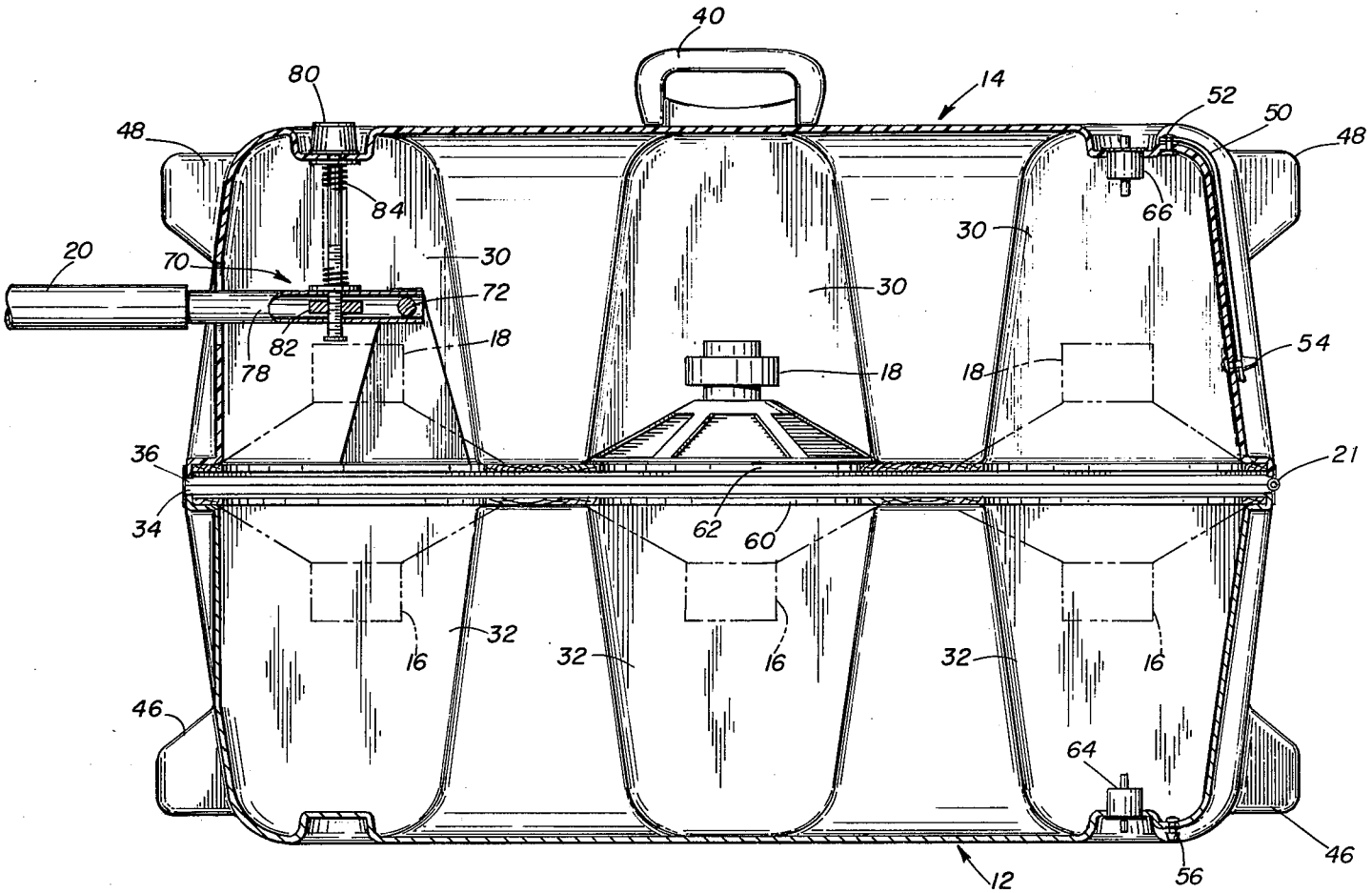
FIG. 2 is a sectional view showing details of the speaker assembly with the pivotally connected shells closed for transportation or storage.
Figure 3:
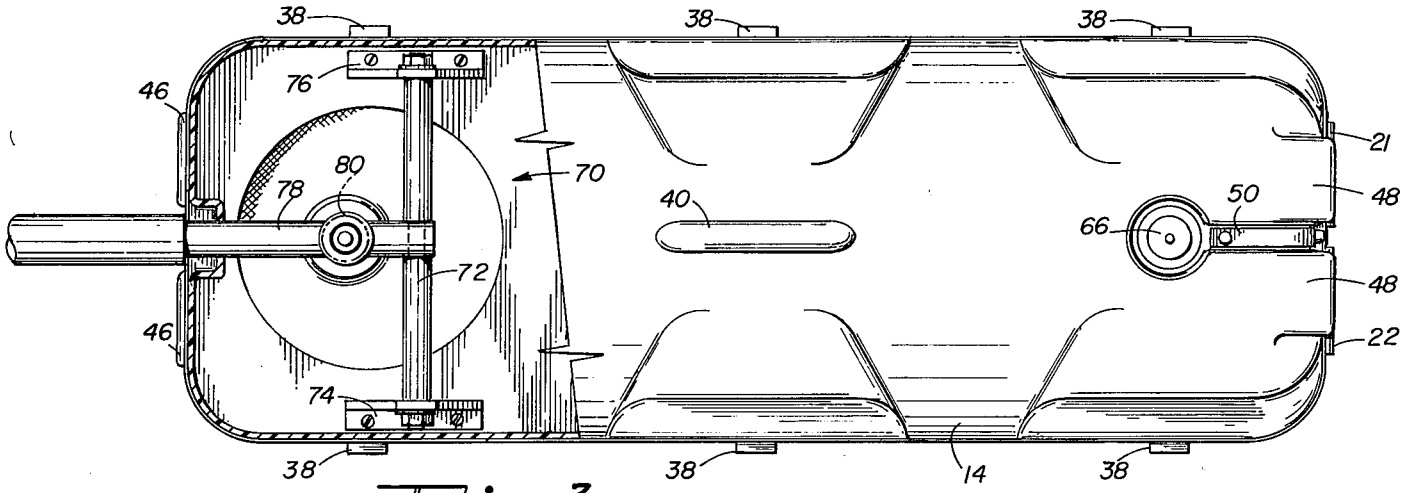
FIG. 3 is a partially sectioned top plan view of the speaker assembly shown in FIG. 2.
Figure 4:
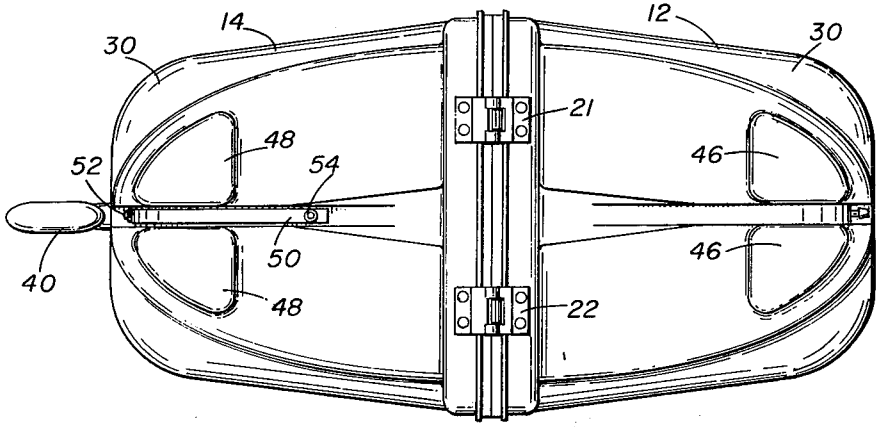
FIG. 4 is an end view of the speaker assembly in FIG. 2.

FIGS. 2–4 illustrate the detailed construction of the speaker assembly 10 and in each instance illustrate the split case with the shells in the closed position. As shown most clearly in FIG. 4, two hinges 21 and 22 pivotally connect the shells at one end of the generally elongated interface between the mating shells. The hinges 21 and 22 define a pivot axis which is perpendicular to the longitudinal direction of the interface and when the shells are pivoted from the closed to the open position, they form the elongated sound column as shown in FIG. 1.

In a preferred embodiment of the invention, the hinges 21 and 22 are separable hinges. Each hinge is comprised of two leaves, the first of which is connected to one of the shells and the second of which is connected to the other of the shells and can be unhooked from the first leaf. Thus, the shells 12 and 14 can be folded open to positions 180° from each other and establish a single linear array of speakers in a sound column or they may be separated to form two individual sound columns one half the length of the sound column shown in FIG. 1.

Each of the shells 12 and 14 defines a plurality of sound compartments 30 or 32 respectively which are arranged serially along the longitudinal axis of the shells. Each of the compartments has a forward opening adjacent the interface of the two shells and is closed at the rear to project sound from the shells when the speakers 16 and 18 are operated. While three such compartments are shown in each shell, it should be understood that the number may be increased or decreased depending upon the size of the speakers and the overall size of the speaker assembly. It will be apparent that the compartments 30 and 32 are longitudinally interconnected; however, it may in certain instances be desirable to isolate one or more of the compartments from the others.

In the illustrated embodiment of the invention, the shells 12 and 14 are molded from a thermoplastic material or the like with the compartments 30 and 32 formed as an integral part of the shell. Additionally, the shells 12 and 14 include light-weight beads or frames 34 and 36 circumscribing the openings of the respective shells and establishing a seal between the shells when they are closed. The frames keep dust, dirt and moisture out of the case when the speaker assembly is stored or transported. A set of latches 38 is distributed around the interface of the shell as shown in FIG. 3 to hold the mated shells closed. An exposed handle 40 is connected to the shell 14 so that the speaker assembly can be conveniently transpoted from place to place with the speaker 16 and 18 securely enclosed within the latched shells.

Four bosses 46 and 48 are provided on the exterior of each shell 12 and 14 and in this embodiment where the shells are molded, the bosses are formed as an integral part of the shell as shown. The bosses serve dual functions. First, when the shells are separated and used as two separate sound columns the bosses act as stands for the shells. Second, when the two shells are open and joined together to form a sound column; as shown in FIGS. 1 and 5, the bosses 46 and 48 at the end of the shells carrying the hinges 21 and 22 are brought into contact with each other and establish a linear alignment of the speakers 16 and 18 and the shells. Thus, the bosses at one end of the shells serve an aligning function for the speaker column when the shells are folded open.

To hold the shells in linear alignment, a strap 50 is permanently anchored at one end to the shell 14 by means of a rivet 52 and is temporarily attached at the opposite end by means of a snap 54. A similar snap 56 is attached to the shell 12 and is located on the shell so that the one end of the strap 50 can be engaged with the snap 56 to hold the shells 12 and 14 in the 180° relationship as shown in FIG. 5.

The speakers 16 are mounted in the shell 12 by means of a baffle plate 60, preferably wood, which is secured to the periphery of the shell opening adjacent the frame 34. In the same manner, speakers 18 are mounted in the shell 14 by means of a baffle plate 62. All speakers are recessed below the interface of the shells to avoid physical interference when the shells close. Each of the baffle plates has openings through which sound generated by the speakers 16 or 18 emanates from the shells. Electrical connecting plugs 64 and 66 are provided in the shells 12 and 14 respectively to connect the internal speakers with a suitable amplifier.

An adjustable mount 70 is provided in one end of the shell 14 opposite the hinges 21 and 22 to receive the upper end of the stand 20. The mount includes a transverse pivot shaft 72 supported in brackets 74 and 76 for rotation relative to the shell 14. A sleeve 78 is suspended from the midpoint of the shaft 72 and extends through a slot in a side wall of the shell 14 so that a limited degree of tilting motion of the sleeve is permitted relative to the shell. The depending end of the sleeve 78 is sized to securely receive the upper end of the stand 20 when the shells are unfolded as shown in FIG. 1. An adjustment screw 80 projects inwardly through the shell and is threadably engaged with a nut plate 82 or other fitting attached to the sleeve 78 so that rotation of the screw permits the angular position of the sleeve 78 and shell to be adjusted. A coil spring 84 mounted coaxially of the screw 80 and extending between the shell and the sleeve provides a constant biasing forcing against the sleeve. It will be understood that when the shell 14 is set upright on the stand 20, the screw 80 can be adjusted to tilt the speakers slightly relative to the horizontal plane. Thus, the sound may be projected to a listening audience at an adjustable angle.

FIG. 6 illustrates a special base for the stand 20 which permits the stand to be completely collapsed when the speaker assembly 10 is transported or placed in storage. The stand includes a support post 90 which fits within the bore of A base block 92. Within the bore, a fixed spring plate 94 supports a snap lock 96 at one end of a pin 98. A spring 100 presses the snap lock downwardly within the base block to engage the inner ends of a plurality of splayed legs 102. Three or more of the legs 102 project radially inward through passageways in the base block to the bore. Nipples formed on the inner ends of the legs are captured by the snap lock and permit easy assembly or disassembly of the stand. It will be understood that when the post 90 is withdrawn from the sleeve 78 and the legs 102 are removed from the base block 92, they may be secured to the shells 12 or 14 or may be stored separately in a convenient carrier.

Thus, a speaker assembly has been disclosed which is light-weight, compact and inexpensive to manufacture. The assembly opens to form an elongated sound column having a plurality of speakers arranged in a linear array and may be folded into a convenient package for transportation and storage. The indivdual shells with their speakers may also be utilized separately.

While the speaker assembly has been described in a preferred embodiment, it should be understood that numerous modifications and substitutions can be had without departing from the spirit of the invention. For example, the molded shell structure is highly desirable because of its light-weight, structural rigidity and the ability to mold the bosses and sound compartments as one unit. However, a multi-piece shell structure is also contemplated. The number of speakers mounted within each shell need not be the same and more than one speaker may be housed within a single sound compartment. The mating shells need not have the same external configuration. Various devices other than the strap 50 may be provided to hold the shells in the open position and the latches 38 may take numerous forms. It is also not essential that the hinges 21 and 22 be separable hinges if individual use of the shells is not contemplated. Also, a single hinge or more than two hinges could be substituted for the hinges 21 and 22. Accordingly, the present invention has been described in a preferred embodiment by way of illustration rather than limitation.

I claim

1. A collapsible speaker assembly comprising:

a split case formed by two mating shells pivotally connected to one another at one side for folding between open and closed positions, the shells at their interface being similar in shape to mate in the closed position and elongated in a longitudinal direction, each shell also defining a plurality of sound compartments arranged serially in the longitudinal direction, each compartment having a forward opening at the interface of the shells and being closed at the rear;

a plurality of speakers mounted to the split case at the forward openings of the serially arranged sound compartments, the speakers being positioned relative to the interface of the shells to permit the pivotal shells to be brought together in mating relationship and thereby close the split case; and releasable means for holding the split case closed when the pivotal shells are brought together in mating relationship.

2. A collapsible speaker assembly as defined in claim 1 wherein the mating shells are pivotally connected at an axis oriented perpendicularly to the longitudinal direction of the two shells.

3. A collapsible speaker assembly as defined in claim 1 including a separable hinge connecting the pivotal shells together at said one side, the hinge having a first portion connected to one shell and a second portion connected to the other shell and hooked to the first portion when the shells are brought together in mating relationship.

4. A collapsible speaker assembly as defined in claim 1 wherein the serially arranged sound compartments of the respective shells are interconnected

5. A collapsible speaker assembly as defined in claim 1 wherein the speakers are mounted in the shells in recessed relationship with the interface of the shells to avoid interference when the split case is closed.

6. A collapsible speaker assembly as defined in claim 1 further including a carrying handle connected with one of the mating shells.

7. A collapsible speaker assembly as defined in claim 1 wherein the pivotally connected shells have a pivot axis extending transverse to the longitudinal directon of the shells and means are included for holding the two pivotally connected shells open in 180° relationship with one another with the sound compartments in a linear array.

8. A collapsible speaker assembly as defined in claim 7 wherein the means for holding the pivotal shells in 180° relationship comprises mating bosses positioned on the respective shells at locations bringing the bosses into abutment when the shells are in 180° relationship with one another.

9. A collapsible speaker assembly as defined in claim 7 wherein the means for holding the two shells in 180° relationship includes a strap interconnecting one point on one shell with another point on the other shell, each point being located remotely of the pivot axis of the shells.

10. A collapsible speaker assembly as defined in claim 1 further including means connected with the split case for supporting the two shells upright with the longitudinal direction generally vertically oriented when the split case is open.

11. A collapsible speaker assembly as defined in claim 10 wherein:

the two pivotally connected shells are joined at one end of their elongated interface by and have a pivot axis perpendicular to the longitudinal direction; and the means for supporting the shells upright includes a stand engageable with one of the shells at a side opposite the pivot axis.

12. A collapsible speaker assembly as defined in claim 11 wherein:

said one of the shells engageable at said one end with the stand contains an adjustable mount receiving the stand, the mount being tiltable relative to the shell to adjust the tilt of the shells on the stand.

13. A collapsible speaker assembly as defined in claim 11 wherein the stand is a collapsible stand.

* * * * *

UNITED STATES PATENT OFFICE

CERTIFICATE OF CORRECTION

Patent No. 4,042,778 Dated August 16, 1977

Inventor(s) Henry H. Clinton

It is certified that error appears in the above-identified patent and that said Letters Patent are hereby corrected as shown below:

Column 2, Line 2, after "plane." delete --, cl--.

Column 3, Line 21, "transpot" should be --transport--.

Column 4, Line 17 "A" (first occurrence) should be --a--.

Column 4, Line 35, "indivdual" should be --individual--.

Column 6, Line 23, after "interface" delete --by--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*